US006503377B1

(12) United States Patent
Borucinski et al.

(10) Patent No.: US 6,503,377 B1
(45) Date of Patent: Jan. 7, 2003

(54) ELECTROLYSIS APPARATUS FOR PRODUCING HALOGEN GASES

(75) Inventors: Thomas Borucinski, Dortmund (DE); Jürgen Gegner, Dortmund (DE); Karl-Heinz Dulle, Olfen (DE); Martin Wollny, Witten (DE)

(73) Assignee: Krupp UHDE GmbH, Dortmund (DE)

( * ) Notice: Subject to any disclaimer, the term of this patent is extended or adjusted under 35 U.S.C. 154(b) by 0 days.

(21) Appl. No.: 09/689,457

(22) Filed: Oct. 12, 2000

Related U.S. Application Data

(63) Continuation of application No. PCT/EP99/02200, filed on Mar. 31, 1999.

(51) Int. Cl.[7] ..... C25B 9/00; C25B 11/03; C25B 11/00

(52) U.S. Cl. ..... 204/257; 204/258; 204/269; 204/270; 204/283; 204/284

(58) Field of Search ..... 204/257–258, 204/263–266, 283–284, 269–270

(56) References Cited

U.S. PATENT DOCUMENTS

| | | | | | |
|---|---|---|---|---|---|
| 4,204,939 | A | * | 5/1980 | Boulton et al. | 204/258 |
| 4,309,264 | A | * | 1/1982 | Bender et al. | 204/256 |
| 4,469,577 | A | * | 9/1984 | Schmitt et al. | 204/252 |
| 4,474,612 | A | * | 10/1984 | Lohrberg | 204/252 |
| 4,511,440 | A | | 4/1985 | Saprokhin et al. | |
| 4,664,770 | A | * | 5/1987 | Schmitt et al. | 204/252 |
| 4,753,718 | A | * | 6/1988 | Chiang | 204/265 |
| 5,194,132 | A | * | 3/1993 | Hartmann et al. | 204/257 |
| 5,660,698 | A | * | 8/1997 | Scannell | 204/252 |

FOREIGN PATENT DOCUMENTS

| | | |
|---|---|---|
| DE | 2420011 C2 | 5/1983 |
| DE | 19641125 A1 | 4/1998 |

OTHER PUBLICATIONS

Patent Abstracts of Japan, C–140 Dec. 16, 1982, vol. 6, No. 257 to JP 57–149476, JP 67–149476 A.

* cited by examiner

*Primary Examiner*—Donald R. Valentine
(74) *Attorney, Agent, or Firm*—Katten Muchin Zavis Rosenman

(57) ABSTRACT

An electrolysis apparatus for producing halogen gases from aqueous alkali halide solution, having a number of plate-like electrolysis cells which are arranged beside one another in a stack and are in electrical contact and which each have a housing comprising two half-shells of electrically conductive material with external contact strips on at least one housing rear wall, and in each case having two essentially flat electrodes (anode and cathode) and the anode and cathode being provided with apertures like venetian blinds for the electrolysis starting materials and the electrolysis products to flow through, being separated from one another by a dividing wall and arranged parallel to one another and being electrically conductively connected to the respective associated rear wall of the housing by means of metal reinforcements, is intended to provide a solution with which, even at current densities above 4 kA/m$^2$ and correspondingly increased production of gas in the boundary layer, it is possible to operate while maintaining lasting service lives of the membrane and with few pulsations.

Figure 1:
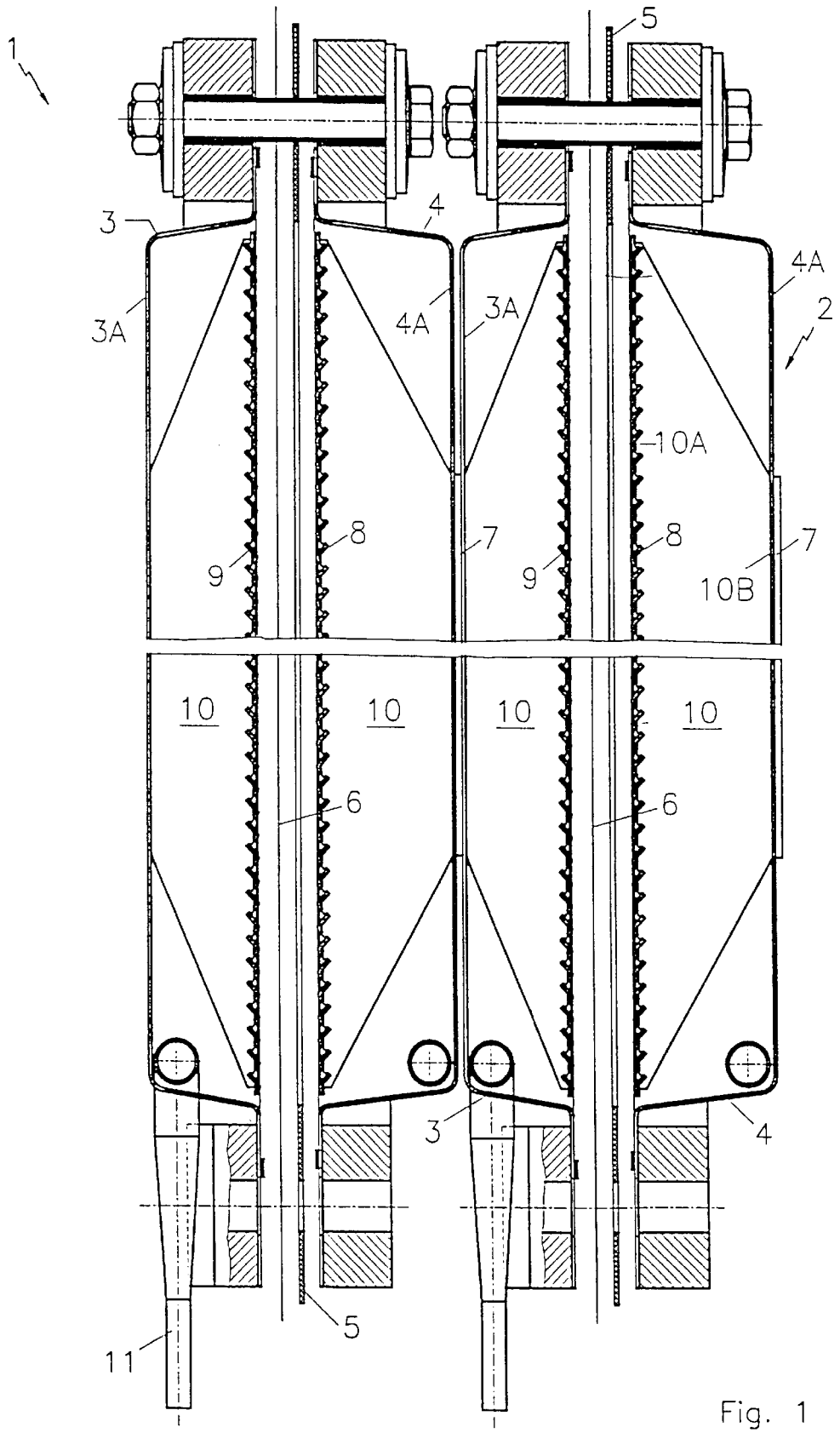

This is achieved by the venetian-blind apertures (8B, 9B) of the anode (8) and cathode (9) being arranged at an angle with respect to the horizontal.

4 Claims, 3 Drawing Sheets

ELECTROLYSIS APPARATUS FOR PRODUCING HALOGEN GASES

This application is a continuation of international application number PCT/EP99/02200, filed on Mar. 31, 1999 which is pending.

The invention relates to an electrolysis apparatus for producing halogen gases from aqueous alkali halide solution, having a number of plate-like electrolysis cells which are arranged beside one another in a stack and are in electrical contact and which each have a housing comprising two half-shells of electrically conductive material with external contact strips on at least one housing rear wall, the housing having devices for feeding the electrolysis current and the electrolysis starting materials and devices for discharging the electrolysis current and the electrolysis products, and in each case having two essentially flat electrodes (anode and cathode), the anode and cathode being provided with apertures like venetian blinds for the electrolysis starting materials and the electrolysis products to flow through, being separated from one another by a dividing wall and arranged parallel to one another and being electrically conductively connected to the respective associated rear wall of the housing by means of metal reinforcements.

The individual electrolysis cells are produced in such a way that the respective housings are assembled from two half-shells in each case with the interposition of the necessary devices and the cathode and anode as well as the dividing wall, and by fixing the same by means of metal reinforcements, and that the anode and housing and cathode and housing are, respectively, electrically conductively fixed to each other, the plate-like electrolysis cells produced in this way then being arranged electrically conductively beside one another in a stack and braced against one another in the stack for the purpose of providing a lasting contact.

The electrolysis current is fed to the cell stack at one outer cell of the stack, it passes through the cell stack in the essentially vertical direction to the central planes of the plate-like electrolysis cells, and it is discharged at the other outer cell of the stack. As referred to the central plane, the electrolysis current reaches average density values of at least 4 $kA/m^2$.

Such an electrolysis apparatus is disclosed by DE 196 41 125 A1 from the same applicant. In the case of this known electrolysis apparatus, the anode and the cathode are connected to the respective rear wall of the halves of the housing via vertical, web-like metal reinforcements. On the rear side of the anode and cathode half-shells, a vertical contact strip for the electrical contact to the adjacent, identically constructed electrolysis cell is fitted in each case. The current flows via the contact strip through the rear wall into the vertical, web-like metal reinforcements and, from there, starting from the metal contact points, (reinforcement/anode), it is distributed over the anode. After the current has passed through the dividing wall (the membrane), it is picked up by the cathode, in order to flow via the vertical, web-like reinforcements into the rear wall on the cathode side and again into the contact strip and, from there, to enter the next electrolysis cell. In this case, the connection between the current-carrying components is performed by welding. At the weld points, the electrolysis current forms peak current densities.

The vertical, web-like metal reinforcements are designed as webs which are aligned with the contact strips and whose lateral edges, over the entire height of the rear wall and the anode or cathode, rest on the rear wall and the anode or cathode.

The vertical webs subdivide the electrode rear space within the respective half of the housing into individual electrolyte-carrying segments. In order that a completely non uniform distribution of the concentration in the electrolyte along the depth of the respective half of the housing does not occur, in each half of the housing, at the bottom, an inlet distributor is provided, via which the electrolysis starting materials can be fed into the individual segments formed by the webs in the half-shells.

By means of an electrolyzer configured in this way, gas-producing electrolysis processes, such as chloralkali electrolysis, hydrochloric acid electrolysis or alkaline water electrolysis, are carried out. In chloralkali electrolysis, aqueous alkali halide solutions, for example sodium and potassium chloride, are decomposed in the electrolysis cell, under the influence of the electrical current, into an aqueous alkali hydroxide solution, for example sodium or potassium hydroxide solution, and into a halogen gas, for example chlorine and hydrogen. In the electrolysis of water, water is decomposed and hydrogen and oxygen are formed at the electrodes.

The physical separation of the electrode spaces is carried out by means of the dividing wall mentioned at the beginning, in general a diaphragm or a so-called ion exchange membrane. The diaphragm consists of a porous material which is chemically, thermally and mechanically stable with respect to the media, temperatures and pressures occurring in the cell. The ion exchange membrane is generally a perfluorated hydrocarbon. These membranes are gas-tight and virtually liquid-tight, but permit the transport of ions in the electrical field.

A particular characteristic of this electrolysis process is the fact that the diaphragm or the ion exchange membrane is pressed against at least one of the two electrodes. This is necessary since, as a result, the dividing wall is fixed and is therefore largely unloaded mechanically. It is often the case that the dividing wall may rest only on one of the two electrodes, since only in this way can the longest possible service life of all the components (electrodes and dividing wall) be achieved. In the event of direct contact between the dividing wall and both electrodes, in some cases a chemical reaction may take place between the dividing wall and the electrodes or the gases developed at the electrodes. For example, a distance between the membrane and the cathode is established in chloralkali electrolysis, since otherwise the electrolysis catalyst or, in the case of inactivated nickel cathodes, nickel is dissolved out of the electrode. Another example is provided by nickel oxide diaphragms, which are used in alkaline water electrolysis. If there is too small a distance from the hydrogen-developing electrode, the nickel oxide is reduced to nickel and therefore becomes conductive, which eventually leads to a short circuit.

Contact between the membrane or diaphragm and at least one electrode, in the case of gas-developing processes, leads to a build-up of gas in the electrolyte boundary layer between the electrode and the membrane or the diaphragm. This even affects the electrodes mentioned at the beginning, which are configured in such a way that the electrolysis starting materials and the electrolysis products can flow through them. Such electrodes are preferably provided with apertures (perforated sheet metal, expanded metal, woven mesh or thin metal sheets with apertures like venetian blinds), so that in spite of their flat arrangement in the electrolysis cell, the gases formed in the boundary layer during the electrolysis can more easily enter the rear space of the electrolysis cell.

The gas bubbles rising in the electrolyte agglomerate in particular in the edges or borders of the apertures, which edges or borders are oriented downward in the cell, and remain there in the interstices between the contacting dividing wall (membrane) and the edges of the apertures. These bubbles disrupt the transport flow, that is to say the transport of materials through the dividing wall, since they block the membrane exchange surface and therefore make it impassable, that is to say inactive.

In the case of an electrode configuration which has been provided by the applicant to reduce this build-up of gas and which is described in German patent specification DE 44 15 146 C2, the electrodes are profiled by being provided with grooves and holes, for example. In this way, firstly the gas can escape more easily and secondly fresh electrolyte can get into the electrolytically active boundary layer between the electrode and the membrane again. If electrodes profiled in this way are loaded with current densities above 4 kA/m$^2$, the development of gas increases still further, however, and the profiled electrode then reaches limit of its ability to discharge gas.

In addition, in gas-developing electrolysis reactions, it also occurs, such as in the anodic development of chlorine in chloralkali electrolysis or the anodic development of oxygen in alkaline water electrolysis, that there is a separation problem, that is to say the developed gas is not separated from the electrolyte, which leads to the formation of foam. This problem leads to the current density distribution being nonhomogeneous, in particular at current densities above 4 kA/m$^2$. As a result, firstly the service life of the active cell components, such as membranes, diaphragms and electrode activators, is restricted. Secondly, the electrolyzers are consequently also limited with regard to the maximum current density to about 4 kA/m$^2$. Additionally, the formation of foam leads to pressure fluctuations within the electrochemical cell, since the foam at least briefly closes the cell outlet for the gas formed. The outlet is blown free again by means of a slight increase in pressure within the cell, which leads to the known effect of surge flow and to the aforementioned pressure fluctuations. This is disadvantageous for the operation of an electrolyzer.

In addition, the service life, in particular of membranes, is influenced by the concentration distribution. The more homogeneous, for example, the sodium chloride concentration in the anode space of a chloralkali electrolyzer, the greater is the service life of the membrane. In order to achieve a homogeneous electrolyte distribution, either additional circulation is produced via pumps arranged externally, or internal circulation is brought about on the basis of a difference in density by installing a guide plate in the cell.

The object of the invention is to provide an electrolysis apparatus which can be operated even at current densities above 4 kA/m$^2$ and consequently increased production of gas in the boundary layer while maintaining lasting service lives of the membrane and with few pulsations.

According to the invention, with an electrolysis apparatus of the type described at the beginning, this object is achieved by the venetian-blind apertures of the anode and cathode being arranged to be inclined with respect to the horizontal.

By means of this configuration according to the invention, as has been shown, the discharge of gas from the electrolyte boundary layer close to the membrane can be improved in such a way that, for the first time, current densities of from 6 to 8 kA/m$^2$ are achieved while maintaining lasting service lives of the membrane. The gas bubbles which are formed roll along on the lower edge of the electrode because of the inclination of the electrode bars with respect to the horizontal, collide with bubbles still adhering to the edge of the electrode and coalesce. This in turn leads to the gas bubbles being accelerated on account of the increasing volume, that is to say the effect accelerates itself. At the same time, the volume of gas in the electroactive zone decreases, as a result of which a lower cell voltage is reached. A suction effect, which is caused by the movement of the gas bubbles along the edge of the electrode, ensures that fresh electrolyte is sucked into the electroactive zone between membrane or diaphragm and electrode, which for example in chloralkali electrolysis is a necessary precondition for a long membrane service life. Furthermore, directed flow occurs, since all the gas bubbles are forced in one direction. As a result, the density of the electrolyte/gas mixture decreases on one side because of the increasing gas content, which leads to an internal circulation which, compared with the occurrence in the electrolyte stream, is greater by the factor 10 to 100. This achieves excellent homogenization of the electrolyte.

It has been shown to be particularly advantageous for the angle of inclination of the venetian-blind apertures with respect to the horizontal to be between 7° and 10°.

In a refinement which is particularly preferred in constructional terms, provision is made for the underside of the respective housing to be arranged parallel to the horizontal and for the venetian-blind apertures of the anode and cathode to be arranged at an angle with respect to the underside of the respective housing. The electrolysis apparatus per se then has to be modified only slightly with respect to known electrolysis apparatus; it is merely necessary for the anode and the cathode to be installed at an angle and configured appropriately at the edge in order that they can be installed appropriately.

Alternatively, provision can also be made for the underside of the respective housing to be arranged at an angle with respect to the horizontal. The individual housings then have to be changed very little by comparison with previously known housings, having merely to be installed at an angle with respect to the horizontal, as a result of which the venetian-blind apertures of cathode and anode are automatically arranged at an angle with respect to the horizontal.

Figure 2:
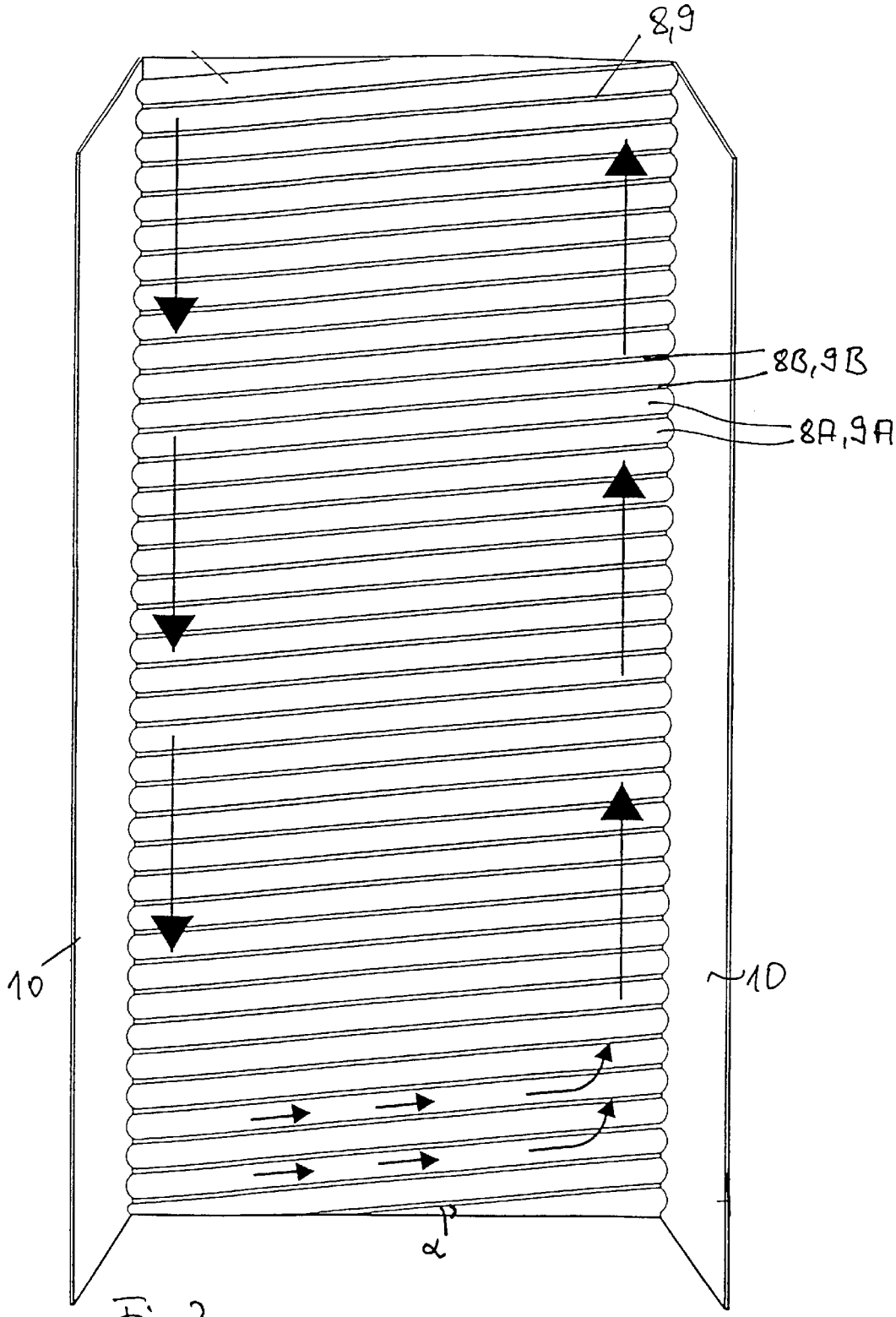
Figure 3:
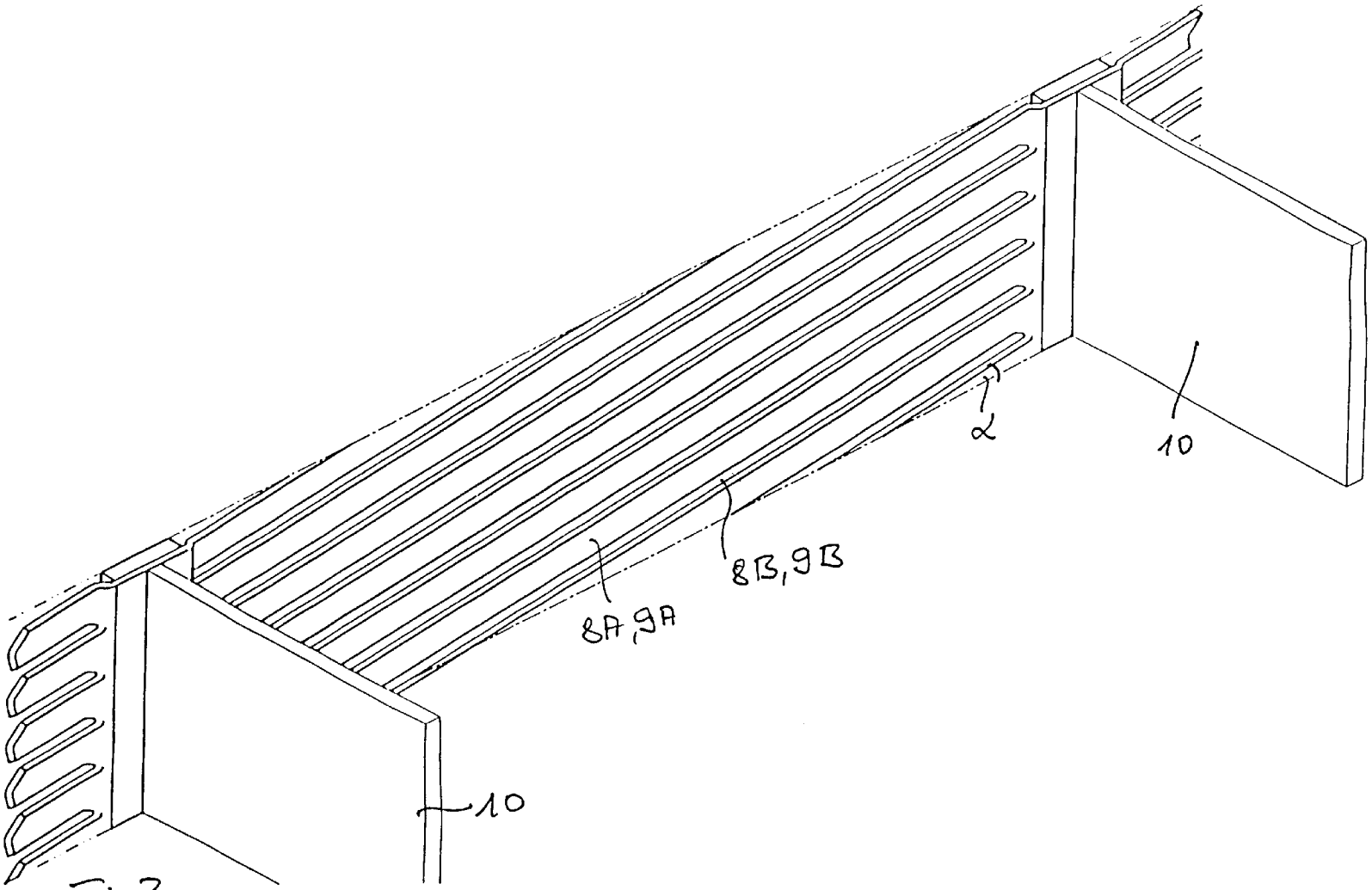

The invention is explained in more detail below by way of example using the drawing, in which FIG. 1 shows a section through two electrolysis cells arranged beside each other in an electrolysis apparatus, FIG. 2 shows a detail from FIG. 1 in a perspective illustration, and FIG. 3 shows an enlarged detail from FIG. 1, likewise in a perspective illustration.

An electrolysis apparatus, designated generally by 1, for producing halogen gases from aqueous alkali halide solution has a number of plate-like electrolysis cells 2 which are arranged beside one another in a stack and are in electrical contact, of which two such electrolysis cells 2 are illustrated arranged beside each other by way of example in FIG. 1. Each of these electrolysis cells 2 has a housing comprising two half-shells 3, 4, which are provided with flange-like edges between which a dividing wall (membrane) 6 is in each case clamped by means of seals 5. The clamping of the membrane 6 can, if appropriate, also be carried out in another way.

Arranged over the entire depth of the housing rear walls 4A of the respective electrolysis cell 2, parallel to one another, are a large number of contact strips 7, which are fixed or fitted to the outer side of the relevant housing rear wall 4A by welding or the like. These contact strips 7 produce the electrical contact with the adjacent electrolysis cell 2, namely with the relevant housing rear wall 3A, which is not provided with its own contact strip.

Provided within the respective housing 3, 4, in each case adjacent to the membrane 6, are a flat anode 8 and a flat cathode 9, the anode 8 and the cathode 9 in each case being connected to reinforcements which are arranged to be aligned with the contact strips 7 and are designed as webs 10. In this case, the webs 10 are preferably fixed in a metallically conductive manner to the anode or cathode 8, 9 along their entire side edge 10A. In order to permit the feeding of the electrolysis starting materials and the discharge of the electrolysis products, starting from the side edges 10A, the webs 10 taper over their width as far as the adjacent side edge 10B, and there have a height which corresponds to the height of the contact strips 7. They are accordingly fixed by their two edges 10B over the entire height of the contact strips 7 to the rear side of the housing rear wall 12A or 4A that is opposite the contact strips 7.

In order to feed the electrolysis starting materials, a suitable device for the respective electrolysis cell 2 is provided, and such a device is indicated by 11. Likewise, a device for discharging the electrolysis products is provided in each electrolysis cell, but this is not shown.

The electrodes (anode 8 and cathode 9) are configured in such a way that they permit the electrolysis starting product and, respectively, the output products 3 to flow through, for which purpose the anode 8 and the cathode 9 are configured in the manner of a venetian blind, that is to say, they each comprise individual electrode bars shaped like a venetian blind, between which there are venetian-blind apertures. This applies both to the anode 8 and to the cathode 9, in each case only one electrode 8, 9 being illustrated in FIGS. 2 and 3. There, the individual electrode bars are designated by 8A and 9A, while the venetian-blind apertures are designated by 8B and 9B. What is essential for the invention is that these venetian-blind apertures 8B, 9B are arranged at an angle with respect to the horizontal, preferably at an angle between 7° and 10°. This angle is designated by $\alpha$ in FIG. 2.

As emerges from FIGS. 2 and 3, the rear space of the electrode 8 or 9 is chambered (that is to say subdivided into a number of chambers) by the vertical webs 10. As has been shown, this configuration leads to the gas bubbles which are formed rolling along on the lower edge of the anode 8 or the cathode 9 as a result of the inclined arrangement of the electrode bars 8A, 9A, then meeting the bubbles still adhering to the edge of the electrode and coalescing. This leads to the gas bubbles being accelerated, because of the increasing volume, so that the effect is itself accelerated. At the same time, the gas volume in the electroactive zone decreases, which results in a low cell voltage. A suction effect, which is brought about by the movement of the gas bubbles along the edge of the electrode, ensures that fresh electrolyte is sucked into the electroactive zone between membrane 6 or diaphragm and electrode 8, 9, which, for example in chloralkali electrolysis, is a necessary precondition for a long membrane service life. Furthermore, a directed flow occurs, since all the gas bubbles are forced in one direction. This flow is indicated by the arrows in FIG. 2. As a result, the density of the electrolyte/gas mixture decreases on one side because of the increasing gas content, which leads to an internal circulation which, compared with the electrolyte current which occurs, is greater by the factor 10 to 100. This achieves excellent homogenization of the electrolyte.

The construction of the electrolysis apparatus otherwise is no different from known electrolysis apparatus. The lining up of a number of plate-like electrolysis cells 2 in a row is made in a frame, the so-called cell frame. The plate-like electrolysis cells 2 are hooked in between the two upper longitudinal beams of the cell frame in such a way that their plate plane is perpendicular to the axis of the longitudinal beams. In order that the plate-like electrolysis cells 2 can transfer their weight to the upper flange of the longitudinal beam, they have, at the upper plate edge on each side, a cantilever-type holder. The holder extends horizontally in the direction of the plane of the plate and projects beyond the border of the flange. When the plate-like electrolysis cells are hooked into the frame, the lower edge of the cantilever holder rests on the upper flange.

The plate-like electrolysis cells 2 hang in the cell frame in a similar way to files in a suspended filing system. In the cell frame, the plate surfaces of the electrolysis cells are in mechanical and electrical contact, as though they have been stacked. Electrolyzers of this design are referred to as electrolyzers of suspended-stack design.

By lining up a number of electrolysis cells 2 in a row in a suspended-stack design by means of known clamping devices, the electrolysis cells 2 are in each case electrically conductively connected via the contact strips 7 to adjacent electrolysis cells in a stack. From the contact strips 7, the current then flows through the half-shells over the webs 10 into the anode 8. After passing through the membrane 6, the current is picked up by the cathode 9, in order to flow via the webs 10 into the other half-shell or the rear wall 3A of the latter and here to cross to the contact strips 7 of the next cell. In this way, the electrolysis current passes through the entire electrolysis cell stack, being introduced at one outer cell and discharged at the other outer cell.

Not illustrated in detail in the figures is the configuration of the electrolysis cells 2 in the lower area, with the electrolyte inlet. The electrolyte can be input both at a point and using a so-called inlet distributor. In this case, the inlet distributor is configured such that a tube is arranged in the element and has openings. Since one half-shell is divided into segments by the webs 10, which constitute the connection between the rear walls 3A and 4A, respectively, and the electrodes 8, 9, an optimum concentration distribution is achieved when both half-shells 3, 4 are equipped with an inlet distributor, the length of the inlet distributor arranged in the half-shell corresponding to the width of the half-shell, and each segment being supplied with the respective electrolyte through at least one opening in the inlet distributor. The sum of the cross-sectional area of the openings in the inlet distributor should in this case be less than or equal to the inner cross section of the distributor tube.

As can be seen in FIG. 1, the two half-shells 3, 4 are provided in the flange area with flanges which are screwed on. The cells built up in this way are either hooked in or placed in a cell frame (not illustrated). They are hooked or placed into the cell frame via holding devices which are located on the flanges but not illustrated. The electrolysis apparatus 1 may comprise a single cell or, preferably, by lining up a number of electrolysis cells 2 in a row in a suspended-stack design. If a number of individual cells are pressed together in accordance with the suspended-stack principle, the individual cells have to be aligned so as to be plane parallel before the clamping device is closed, since otherwise the transmission of current from one individual cell to the next cannot take place via all the contact strips 7. In order to be able to align the cells in parallel after they have been hooked or placed into the cell frame, it is necessary for the elements, which usually weigh about 210 kg in the empty state, to be capable of being moved easily. In order to meet this precondition, the holders or supporting surfaces located on the cell framing and cell frame (not illustrated) are provided with associated coatings. In this case, the holders located on the element flange framing are interfaced with a plastic, for example PE, PP, PVC, PFA, FEP, E/TFE, PVIF or PTFE, while the supporting surfaces on the cell frame are likewise coated with one of these plastics. The plastic can merely be placed on or guided via a groove, bonded on, welded on or screwed on. The important factor is merely that the plastic support is fixed. Because two plastic faces contact each other, the individual elements located in the frame can be moved so easily that they can be aligned in parallel by hand without any additional lifting or shifting device. When the clamping device is closed, the elements make flat contact over the entire rear wall, because of their ability to be displaced easily in the cell frame, which is the precondition for a uniform current distribution. Furthermore, in this way, the cell is electrically isolated with respect to the cell frame.

Of course, the invention is not restricted to the embodiments illustrated in the drawings. Further configurations are possible without leaving the basic idea. For example, the respective electrodes 8, 9 can be installed at an angle in the respective electrolyte cell 2 so as to correspond to the inclination of the venetian-blind apertures 8B, 9B, and the electrode bars 8A, 9A of the two electrodes 8, 9 with respect to the horizontal, as illustrated. Alternatively, however, provision can also be made for the entire electrolysis cell to be arranged at an angle, in such a way that the underside of the respective housing half-shell is arranged at an angle with respect to the horizontal, so that necessarily the venetian-blind apertures 8A, 9B are also arranged at an angle and the effect described in relation to FIGS. 2 and 3 is established.

What is claimed is:

1. An electrolysis apparatus for producing halogen gases from aqueous alkali, halide solution, having a number of plate-like electrolysis cells which are arranged beside one another in a stack and are in electrical contact and which each have a housing comprising two half-shells of electrically conductive material with external contact strips on at least one housing rear wall, the housing having devices for feeding the electrolysis current and the electrolysis products, and in each case having two essentially flat electrodes (anode and cathode), the anode and cathode being provided with apertures like venetian blinds for the electrolysis starting materials and the electrolysis products to flow through, being separated from one another by a dividing wall and arranged parallel to one another and being electrically conductively connected to the respective associated rear wall of the housing by means of metal reinforcements, wherein the venetian-blind apertures (8B, 9B) of the anode (8) and cathode (9) are arranged at an angle with respect to the horizontal.

2. The electrolysis apparatus as claimed in claim 1, wherein the angle of inclination of the shaped rib structures comprising shaped apertures (8B, 9B) with respect to the horizontal is between 7° and 10°.

3. The electrolysis apparatus as claimed in claim 1 or 2, wherein the underside of the respective housing (3,4) is arranged parallel to the horizontal, and the with shaped rib structures comprising shaped apertures (8B, 9B) of the anode (8) and cathode (9) are arranged at an angle with respect to the underside of the respective housing (3, 4).

4. The electrolysis apparatus as claimed in claim 1 or 2, wherein the underside of the respective housing (3, 4) is arranged at an angle with respect to the horizontal.

* * * * *